US009551313B2

(12) United States Patent
Ishimori

(10) Patent No.: US 9,551,313 B2
(45) Date of Patent: Jan. 24, 2017

(54) ENGINE COLD START WARMUP METHOD

(71) Applicant: HINO MOTORS, LTD., Hino-shi, Tokyo (JP)

(72) Inventor: Takashi Ishimori, Tokyo (JP)

(73) Assignee: HINO MOTORS, LTD., Hino-shi (JP)

( * ) Notice: Subject to any disclaimer, the term of this patent is extended or adjusted under 35 U.S.C. 154(b) by 53 days.

(21) Appl. No.: 14/653,625

(22) PCT Filed: Dec. 19, 2012

(86) PCT No.: PCT/JP2012/008115

§ 371 (c)(1),
(2) Date: Jun. 18, 2015

(87) PCT Pub. No.: WO2014/097354

PCT Pub. Date: Jun. 26, 2014

(65) Prior Publication Data

US 2015/0330352 A1 Nov. 19, 2015

(51) Int. Cl.

| | |
|---|---|
| ***F02N 19/10*** | (2010.01) |
| ***F02N 19/00*** | (2010.01) |
| ***F01P 7/16*** | (2006.01) |

(52) U.S. Cl.

CPC ..... *F02N 19/10* (2013.01); *F01P 7/162* (2013.01); *F02N 19/001* (2013.01); *F01P 2037/02* (2013.01); *F02N 2200/023* (2013.01)

(58) Field of Classification Search

CPC .. F02N 19/10; F02N 19/001; F02N 2200/023; F01P 7/162; F01P 2037/02; F02B 49/02; F02B 39/06

(Continued)

(56) References Cited

U.S. PATENT DOCUMENTS

| | | | | |
|---|---|---|---|---|
| 6,681,725 | B2 * | 1/2004 | Kobayashi | F01P 7/16 123/142.5 R |
| 8,376,714 | B2 * | 2/2013 | Park | F01P 7/162 123/41.01 |
| 8,408,168 | B2 * | 4/2013 | Suzuki | F01P 7/164 123/41.02 |

FOREIGN PATENT DOCUMENTS

| | | | |
|---|---|---|---|
| JP | 2003-278544 | A | 10/2003 |
| JP | 2008-169750 | A | 7/2008 |

(Continued)

OTHER PUBLICATIONS

International Search Report Issued Mar. 26, 2013 in PCT/JP12/008115 Filed Dec. 19, 2012.

*Primary Examiner* — Grant Moubry
(74) *Attorney, Agent, or Firm* — Oblon, McClelland, Maier & Neustadt, L.L.P.

(57) ABSTRACT

A cooling-water temperature is detected at startup of an engine. When the detected temperature falls below a set water-temperature, a water pump is stopped independently of a normal control on rotational frequency of the water pump depending on engine operational state. Calculated is a total heat amount required for raising the current water-temperature to the set water-temperature, and integrated is an heat amount lost by the cooling water from the engine from the startup. When an integrated value reaches the total heat amount, the water pump is operated for a required time to uniformize temperature distribution of the cooling water. Then, the cooling-water temperature is detected again. If the detected temperature is still below the set water-temperature, the same control is repeated; if the detected temperature is equal to or greater than the set water-temperature, the normal control is restored.

6 Claims, 3 Drawing Sheets

(58) Field of Classification Search
USPC .. 123/142.5 R, 142.5 E, 198 C, 41.02, 41.44
See application file for complete search history.

(56) References Cited

FOREIGN PATENT DOCUMENTS

| | | | |
|---|---|---|---|
| JP | 2010-190048 | A | 9/2010 |
| JP | 2010-190142 | A | 9/2010 |
| JP | 2011-220156 | A | 11/2011 |
| JP | 2012-132379 | A | 7/2012 |

* cited by examiner $T_1$ : SET WATER TEMPERATURE
$T_0$ : DETECTED WATER TEMPERATURE
$V_{ENG}$ : MASS FLOW RATE OF COOLING WATER IN ENGINE
$C_{pw}$ : SPECIFIC HEAT OF COOLING WATER

ENGINE COLD START WARMUP METHOD

TECHNICAL FIELD

The present invention relates to a method for warming an engine at cold startup.

BACKGROUND ART

Generally, a thermostat is arranged for cooling-water circulation passages in a cooling system for an engine of a vehicle. When a temperature of cooling water is low at cold startup, the thermostat operates to close a water passage for circulation of cooling water between the engine and a radiator and open a water passage for return of the cooling water from the engine to the engine without via the radiator, whereby the cooling water is circulated without passing through the radiator to prioritize warming of the engine.

As is old and well-known, this kind of thermostat operates on a mechanical basis such that increase in temperature of the cooling water dissolves and increases in volume of wax enclosed in a casing, which triggers a needle, a spring or the like to open a valve.

There is, for example, the following Patent Literature 1 as a related art literature pertinent to such kind of cooling system for an engine.

CITATION LIST

Patent Literature

Patent Literature 1: JP 2003-278544A

SUMMARY OF INVENTION

Technical Problems

However, substantially voluminous is even portion of the cooling water which is to be circulated in the engine without via the radiator at the cold startup. It is not until all of the cooling water is warmed that the warming of the engine is completed, which elongates a time required for warming the engine and disadvantageously brings about deterioration in fuel economy.

Specifically, lubricating oil in respective cylinders is high in viscosity until the warming of the engine is completed; and the lubricating oil remains to have great friction loss until the oil becomes warmed and lowered in viscosity, so that fuel economy is deteriorated during the warming.

Moreover, a state where even exhaust temperature is not raised continues for a while just after the cold startup, which delays attainment of a bed temperature of an emission control catalyst incorporated in an exhaust passage (e.g., an $NO_x$ storage reduction catalyst, a selective reduction catalyst, an oxidation catalyst or a three way catalyst) to an active temperature, and disadvantageously elongates a time period of the emission control catalyst not effectively functioning just after the cold startup.

The invention was made in view of the above and has its object to make shorter a time period required for warming of an engine than ever before to improve fuel economy during the warming and early activate an emission control catalyst in an exhaust passage.

Solution to Problems

The invention is directed to a method for warming an engine at cold startup wherein a water pump controllable in flow rate is employed for a cooling water system of the engine, a rotational frequency of said water pump being controlled to circulate cooling water at a flow rate depending on an operational state of the engine, characterized in that the method comprises detecting a water temperature of the cooling water at the startup of the engine; and, when the detected water temperature falls below a set water temperature, stopping the water pump independently of a normal control of controlling the rotational frequency of the water pump depending on the operational state of the engine and calculating a total heat amount required for raising a current water temperature to said set water temperature, integrating an heat amount lost by the cooling water from the engine since the startup of the engine, operating the water pump for a required time to uniformize temperature distribution of the cooling water upon attainment of an integrated value to said total heat amount, and then detecting the water temperature of the cooling water again, repeating the same control and restoring the normal control when the detected water temperature is still below and is the same or above the set water temperature, respectively.

Thus, in this case, the water pump is forcedly stopped to stop the circulation of the cooling water in the engine when the detected water temperature falls below the set water temperature at the startup of the engine, whereby the engine is early warmed to substantially shorten a time required for the warming. As a result, the lubricating oil in respective cylinders becomes lowered in viscosity at an early stage to make friction loss lesser to thereby improve fuel economy during the warming; and the exhaust temperature is raised at the early stage to instantly warm and early activate the emission control catalyst.

Moreover, calculated is the total heat amount required for raising the current water temperature to the set water temperature. After the heat amount lost by the cooling water integrated into a value corresponding to the total heat amount is ascertained, the water temperature of the cooling water is detected again to determine whether the normal control is to be restored or not, which prevents the cooling water from being abnormally raised in water temperature due to the stopped water pump.

In this case, an outage time of the water pump is increased/decreased depending on the detected water temperature of the cooling water. The outage time becomes relatively long and short if the detected water temperature is substantially and slightly below the set water temperature, respectively. This means that a proper outage time of the water pump is set irrespective of any water temperature condition.

In the invention, for calculation of the total heat amount required for raising the current water temperature to the set water temperature, the detected water temperature may be subtracted from the set water temperature to obtain a difference; the difference is multiplied by a mass flow rate of the cooling water in the engine to obtain a product; the product is multiplied by a specific heat of the cooling water to thereby obtain the total heat amount.

In the invention, a control map may be used which can read out an heat amount lost by the cooling water in view of various information indicative of the operational status of the engine; the heat amount lost by the cooling water may be read out from the control map on the basis of the various information in the current operational state of the engine. Alternatively, the heat amount lost by the cooling water may be obtained such that an amount of heat generation by fuel is calculated on the basis of an injection amount of the fuel, and a part thereof used for engine output and a part thereof heat-released to the exhaust are subtracted from the amount of heat generation by the fuel.

Advantageous Effects of Invention

According to a method for warming an engine at a cold startup of the invention, various excellent effects can be exhibited:

(I) The water temperature of the cooling water is detected at the startup of the engine. When the detected water temperature falls below the set water temperature, the water pump is forcedly stopped to stop the circulation of the cooling water in the engine, whereby the engine can be early warmed, which can substantially shorten the time required for warming at the cold startup. As a result, the lubricating oil in the respective cylinders of the engine can be early lowered in viscosity. As a result, the friction loss can be made lesser to improve the fuel economy during the warming and the exhaust temperature can be raised early after the cold startup, whereby the emission control catalyst in the exhaust passage can be warmed in a short time and early activated.

(II) The total heat amount required for raising the current water temperature to the set water temperature is calculated. After the heat amount lost by the cooling water integrated into a value corresponding to the total heat amount is ascertained, the temperature of the cooling water is detected again to determine whether the normal control is to be restored or not. As a result, the cooling water can be prevented from being abnormally raised in water temperature due to the stopped water pump.

DESCRIPTION OF EMBODIMENT

Next, an embodiment of the invention will be described in conjunction with the drawings.

Figure 1:
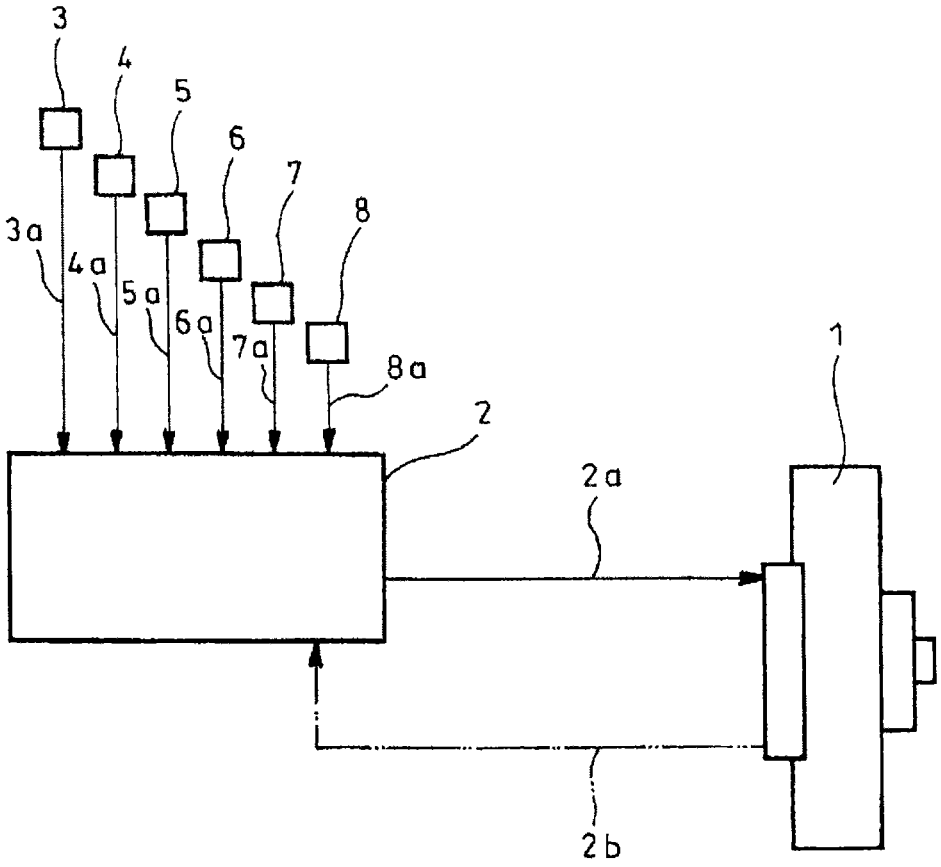
FIG. 1 is a schematic view showing an embodiment of the invention.
Figure 2:
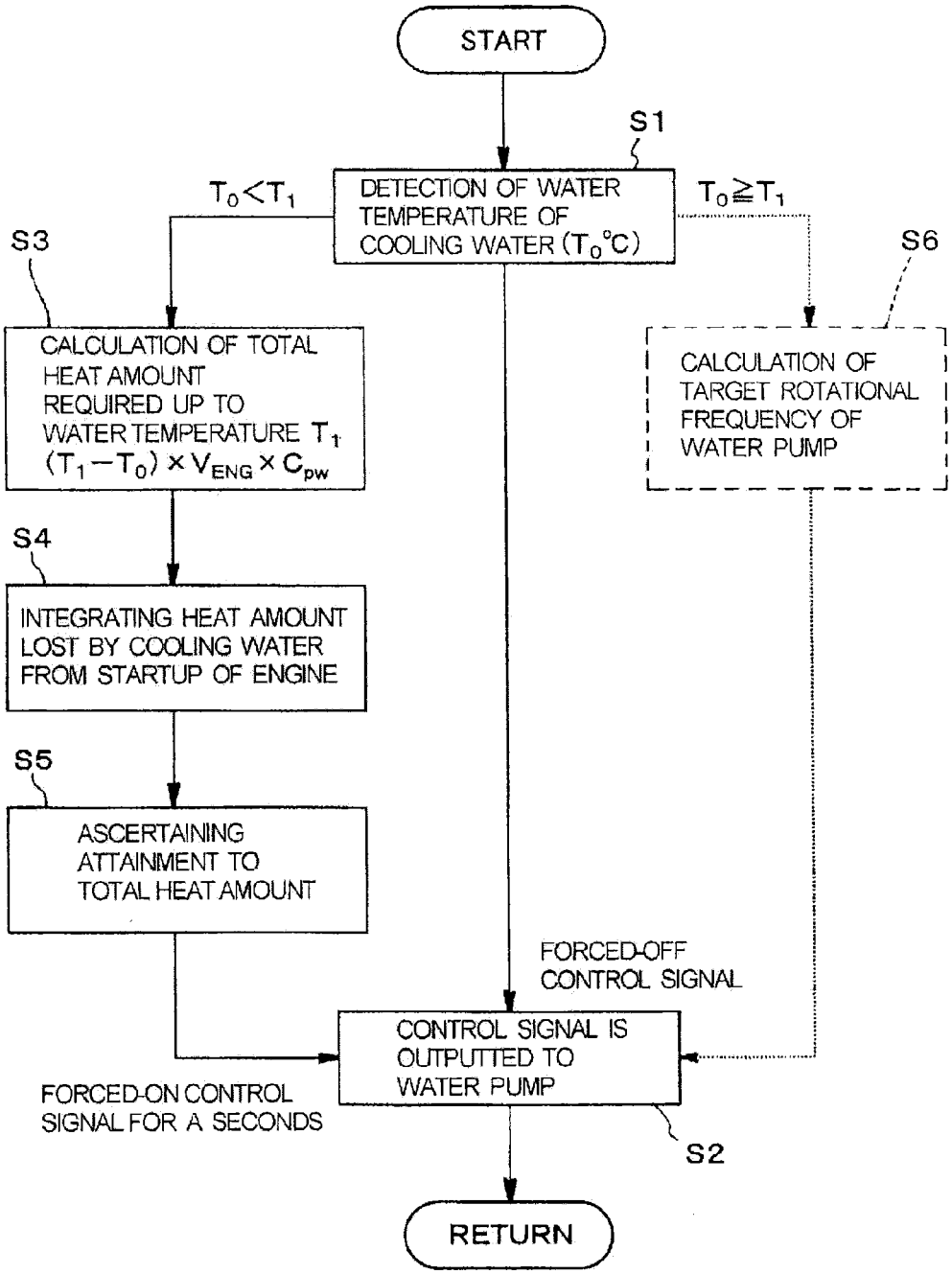
FIG. 2 is a flow chart showing specific control procedures in a controller in FIG. 1.
Figure 3:
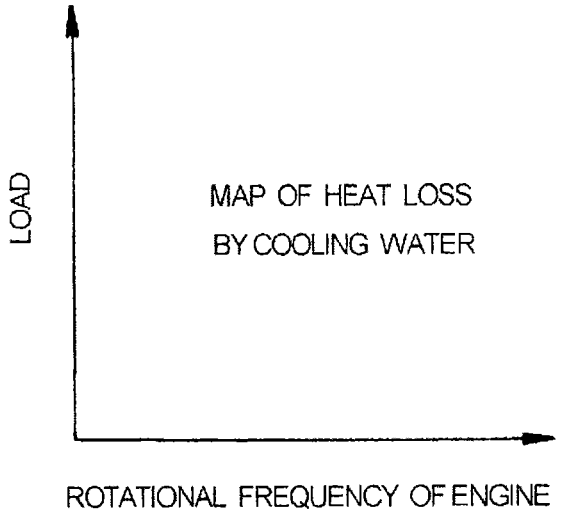
FIG. 3 is a view showing an image of a control map for readout of a heat amount lost by cooling water.

FIGS. 1-3 show the embodiment of the invention. In FIG. 1, reference numeral 1 denotes a water pump employed for a cooling-water system for an engine and controllable in flow rate. The water pump 1 is operated by belt drive from an engine and is provided with a clutch mechanism steplessly regulatable in degree of slide. The water pump 1 used and controllable in flow rate, itself, is well-known in a field of an automobile.

The water pump 1 is adapted to be controlled in rotational frequency on a basis of a control signal 2*a* from a controller 2. Inputted to the controller 2 are, for example, a detection signal 3*a* from a rotational sensor 3 for detection of a rotational frequency of the engine, a detection signal 4*a* from a temperature sensor 4 for detection of a water temperature of the cooling water, a signal 5*a* from a control system 5 on fuel injection to the engine and indicative of an indicated value of a fuel injection amount, a detection signal 6*a* from a temperature sensor 6 for detection of an exhaust temperature, a detection signal 7*a* from a temperature sensor 7 for detection of an intake temperature and a detection signal 8*a* from a flow rate sensor 8 for detection of an intake amount (mass flow rate).

In the controller 2, a normal control is performed by controlling a rotational frequency of the water pump 1 to circulate the cooling water at a flow rate depending on an operational state of the engine. The normal control is performed such that the water pump 1 is increased/decreased in rotational frequency to have a cooling performance consistent with much/less amount of heat generation of the engine under the operational state of the engine, respectively.

Upon control of the rotational frequency of the water pump 1 by the controller 2 to a target rotational frequency, the rotational frequency of the water pump 1 may be actually measured as needs demands and returned as actual rotational frequency signal 2*b* to the controller 2 to perform feedback control.

In the normal control as mentioned in the above, it is arbitrary what information is used as a basis for determining the operational state of the engine. For example, a control logic employed for control of a cooling fan controllable in rotational frequency (and having a clutch mechanism) and actually implemented for some of automobiles may be applied as it is.

In this regard, as shown in FIG. 2 in the form of a flowchart on specific control procedures in the controller 2 shown in FIG. 1, the water temperature of the cooling water is detected in step S1 at the startup of the engine. When the detected water temperature $T_0$ falls below a set water temperature $T_1$, a cold startup control detailed hereinafter is performed independently of the normal control.

Specifically, the water temperature of the cooling water is detected in step S1. When the detected water temperature $T_0$ falls below the set water temperature $T_1$, instantly performed is a determination on stoppage of the water pump 1; in step S2, a control signal 2*a* is outputted to stop the water pump 1 while step S3 is taken where calculated is a total heat amount required for raising the current water temperature to the set water temperature $T_1$.

Upon the calculation of the total heat amount required for raising the current water temperature to the set water temperature $T_1$, the detected water temperature $T_0$ may be subtracted from the set water temperature $T_1$ to obtain a difference; the difference is multiplied by a mass flow rate of the cooling water in the engine to obtain a product; and the product is multiplied by a specific heat of the cooling water to obtain the total heat amount.

In next step S4, integrated is an heat amount lost by the cooling water from the engine since the startup of the engine; in next step S5, after the heat amount lost by the cooling water integrated into a value corresponding to the total heat amount required for raising the current water temperature to the set water temperature $T_1$ is ascertained, a determination is made on an operation of the water pump 1 only for a required time (A seconds) to uniformize temperature distribution of the cooling water; and in step S2, the control signal 2*a* is outputted to the water pump 1 for operation thereof only for the required time (A seconds).

As to the heat amount lost by the cooling water from the engine, for example, a control map (see FIG. 3) may be employed which can read out the heat amount lost by the cooling water in view of various information indicative of the operational state of the engine such as a load and a rotational frequency of the engine; the heat amount lost by the cooling water may be read out and obtained from the control map on the basis of various information (the load and the rotational frequency of the engine) in the current operational state of the engine.

Other than through such readout of the heat amount lost by the cooling water using the control map, the heat amount lost by the cooling water may be obtained such that an amount of heat generation by fuel is calculated on the basis of a fuel injection amount, and a part thereof used for engine output and a part thereof heat-released to the exhaust are subtracted from the amount of heat generation by the fuel; in this case, a part thereof consumed as friction loss is assumed to be converted into frictional heat which is robbed of by the engine (such heat is utilized for raising a temperature of engine oil).

The amount of heat generation by the fuel may be obtained by calculation on the basis of the fuel injection amount; a part thereof used for engine output may be read out from the control map on the basis of various information indicative of the operational state of the engine such as a load and a rotational frequency of the engine or may be obtained by use of an output measured in a real machine test; a part thereof heat-released to the exhaust may be obtained such that an intake temperature is subtracted from an exhaust temperature to obtain a difference which is multiplied by an intake amount (mass flow rate).

Further, in previous step S2, after the control signal 2*a* is outputted to the water pump 1 for the operation thereof only for the required time (A seconds), the procedure is returned to step S1 where a water temperature of the cooling water is detected again. When the detected water temperature $T_0$ is still below the set water temperature $T_1$, the same cold startup control is repeated; when the detected temperature is equal to or greater than the set water temperature, the normal control is restored and step S6 is taken where a target rotational frequency of the water pump 1 is calculated depending on the operational state of the engine; the target rotational frequency calculated is outputted as control signal 2*a* to the water pump 1 in next step S2.

Thus, in this case, the water pump 1 is forcedly stopped to stop the circulation of the cooling water in the engine when the detected water temperature $T_0$ of the cooling water falls below the set water temperature $T_1$ at the startup of the engine, whereby the engine is early warmed to substantially shorten a time required for the warming. As a result, lubricating oil in respective cylinders becomes lowered in viscosity at an early stage to make friction loss lesser to thereby improve fuel economy during the warming; and the exhaust temperature is raised at an early stage to instantly warm and early activate the emission control catalyst in the exhaust passage.

Moreover, calculated is the total heat amount required for raising the current water temperature to the set water temperature $T_1$. After the heat amount lost by the cooling water integrated to a value corresponding to the total heat amount is ascertained, the water temperature of the cooling water is detected again to determine whether the normal control is to be restored or not, which prevents the cooling water from being abnormally raised in water temperature due to the stopped water pump 1.

In this case, an outage time of the water pump 1 is increased/decreased depending on the detected water temperature $T_0$ of the cooling water. The outage time is relatively long and short if the detected water temperature $T_0$ is substantially and slightly below the set water temperature $T_1$, respectively. This means that a proper outage time of the water pump 1 is set irrespective of any water temperature condition.

Thus, according to the above-mentioned embodiment, the water temperature of the cooling water is detected at the startup of the engine. When the detected water temperature $T_0$ falls below the set water temperature $T_1$, the water pump 1 is forcedly stopped to stop the circulation of the cooling water in the engine and early warm the engine and substantially make shorter the time required for warming at the cold startup than ever before, so that lubricating oil in the respective cylinders can be lowered in viscosity at an early stage, whereby the friction loss can be made lesser to improve the heat economy during the warming and the exhaust temperature can be raised at an early stage after the cold startup, which makes it possible to warm the emission control catalyst in the exhaust passage within a short period of time and early activate the same.

Further, the total heat amount required for raising the current water temperature to the set water temperature $T_1$ is calculated, and after the heat amount lost by the cooling water integrated to a value corresponding to the total heat amount is ascertained, the water temperature of the cooling water is detected again to determine whether the normal control is to be restored or not, which makes it possible to prevent the cooling water from being abnormally raised in water temperature due to the stopped water pump 1.

REFERENCE SIGNS LIST

1 water pump
2 controller
2*a* control signal

The invention claimed is:

1. A method for warming an engine at cold startup wherein a water pump controllable in flow rate is employed for a cooling water system of the engine, a rotational frequency of said water pump being controlled to circulate cooling water at a flow rate depending on an operational state of the engine, the method comprising detecting a water temperature of the cooling water at the startup of the engine; and, when the detected water temperature falls below a set water temperature, stopping the water pump independently of a normal control of controlling the rotational frequency of the water pump depending on the operational state of the engine and calculating a total heat amount required for raising a current water temperature to said set water temperature, integrating a heat amount lost by the cooling water from the engine since the startup of the engine, operating the water pump for a required time to uniformize temperature distribution of the cooling water upon attainment of an integrated value to said total heat amount, and then detecting the water temperature of the cooling water again, repeating the method when the detected water temperature is still below the set water temperature and restoring the normal control when the detected water temperature is the same or above the set water temperature.

2. The method for warming the engine at cold startup as claimed in claim 1, wherein for calculation of the total heat amount required for raising the current water temperature to the set water temperature, the detected water temperature is subtracted from the set water temperature to obtain a difference, the difference being multiplied by a mass flow rate of the cooling water in the engine to obtain a product, the product being multiplied by a specific heat of the cooling water to thereby obtain said total heat amount.

3. The method for warming the engine at cold startup as claimed in claim 1, wherein a control map is used which can read out a heat amount lost by the cooling water in view of various information indicative of an operational state of the engine, the heat amount lost by the cooling water being read out from said control map based on the basis of the various information on the current operational state of the engine.

4. The method for warming the engine at cold startup as claimed in claim 1, wherein an amount of heat generation by fuel is calculated based on fuel injection amount, and a part thereof used for engine output and a part thereof heat-released to the exhaust are subtracted from said amount of heat generation by the fuel to obtain the heat amount lost by the cooling water.

5. The method for warming the engine at cold startup as claimed in claim 2, further comprising: determining from a control map a heat amount lost by the cooling water in view of various information indicative of an operational state of the engine, the heat amount lost by the cooling water being read out from said control map based on operational state of the engine.

6. The method form warming the engine at cold startup as claimed in claim 2, further comprising: calculating an amount of heat generation by fuel based on a fuel injection amount, and subtracting a part thereof used for engine output and a part thereof heat-released to the exhaust from said amount of heat generation by the fuel to obtain the heat amount lost by the cooling water.

* * * * *